US007517058B2

(12) United States Patent
Hayakawa et al.

(10) Patent No.: US 7,517,058 B2
(45) Date of Patent: Apr. 14, 2009

(54) INK JET RECORDING HEAD HAVING STRUCTURAL MEMBERS IN INK SUPPLY PORT

(75) Inventors: Kazuhiro Hayakawa, Kanagawa (JP); Makoto Terui, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 433 days.

(21) Appl. No.: 11/377,391

(22) Filed: Mar. 17, 2006

(65) Prior Publication Data

US 2006/0214995 A1 Sep. 28, 2006

(30) Foreign Application Priority Data

Mar. 23, 2005 (JP) ..... 2005-083556

(51) Int. Cl.
*B41J 2/05* (2006.01)

(52) U.S. Cl. ..... 347/63; 347/65

(58) Field of Classification Search ..... 347/20, 347/44, 47, 54, 56, 61–65, 67, 92–94
See application file for complete search history.

(56) References Cited

U.S. PATENT DOCUMENTS

| | | | | |
|---|---|---|---|---|
| 5,317,346 | A | 5/1994 | Garcia | 347/63 |
| 6,045,214 | A * | 4/2000 | Murthy et al. | 347/47 |
| 6,126,271 | A | 10/2000 | Terui | 347/50 |
| 6,139,761 | A | 10/2000 | Ohkuma | 216/27 |
| 6,155,673 | A | 12/2000 | Nakajima et al. | 347/61 |
| 6,412,921 | B1 * | 7/2002 | Manini | 347/65 |
| 6,467,884 | B1 | 10/2002 | Murooka et al. | 347/64 |
| 6,582,053 | B1 | 6/2003 | Terui | 347/20 |
| 6,869,168 | B2 | 3/2005 | Terui | 347/50 |
| 7,063,799 | B2 | 6/2006 | Hayakawa et al. | 347/63 |
| 2004/0238485 | A1 | 12/2004 | Hayakawa et al. | 347/27 |
| 2005/0140716 | A1 | 6/2005 | Terui | 347/20 |
| 2005/0140737 | A1 | 6/2005 | Ushijima et al. | 347/64 |
| 2005/0248623 | A1 | 11/2005 | Komuro et al. | 347/58 |
| 2006/0098050 | A1 | 5/2006 | Terui | 347/61 |
| 2006/0191862 | A1 | 8/2006 | Hayakawa et al. | 347/27 |
| 2006/0256162 | A1 | 11/2006 | Hayakawa | 347/65 |
| 2007/0058001 | A1 | 3/2007 | Hayakawa | 347/65 |

FOREIGN PATENT DOCUMENTS

| | | |
|---|---|---|
| JP | 6-115075 | 4/1994 |
| JP | 2003-39692 | 2/2003 |

OTHER PUBLICATIONS

*Note: Counterpart U.S. patent also cited (see text of IDS).

* cited by examiner

*Primary Examiner*—Juanita D Stephens
(74) *Attorney, Agent, or Firm*—Fitzpatrick, Cella, Harper & Scinto

(57) ABSTRACT

An ink jet recording head has sufficient and uniform ink refill for all orifices and separate flow paths even though the substrate has high rigidity by dividing a supply port into a plurality of ports. The substrate of the ink jet recording head has a plurality of separate flow paths corresponding to discharge pressure generating elements, a common flow path communicating with the separate flow paths, an ink supply port communicating with the common flow path and supplying ink to the common flow path, and a plurality of beam portions dividing the ink supply port. A recess is formed on the common flow path, extending to the separate flow paths formed nearest to the beam portion.

3 Claims, 8 Drawing Sheets

INK JET RECORDING HEAD HAVING STRUCTURAL MEMBERS IN INK SUPPLY PORT

BACKGROUND OF THE INVENTION

1. Field of the Invention

The present invention relates to an ink jet recording head for recording data by discharging ink and a manufacture method for the ink jet recording head.

2. Related Background Art

As an ink jet recording head to be used for an ink jet recording system for recording data by discharging ink, a so-called "side shooter type recording head" is known which discharges an ink droplet along a direction perpendicular to a substrate formed with ink discharge energy generating elements.

As a liquid discharge method for this recording head, the specification of U.S. Pat. No. 6,155,673 discloses the structure that an ink droplet is discharged when a bubble formed by heating a heat generating resistor member communicates with external air. According to this discharge method, small droplet recording can be realized easily and recent high precision recording requirements are satisfied.

The structure of a "side shooter type recording head" is known by which ink is supplied from the bottom of a substrate to discharge pressure generating elements via a supply port and a common flow path and separate flow paths. As a manufacture method for an ink jet recording head having this structure, for example, the specification of U.S. Pat. No. 6,139,761 discloses a method of forming an ink supply port in a device substrate by anisotropical etching.

Recent needs are to develop a head which has a long train of orifices and can draw a large area at one scan. As the orifice train is elongated, the ink supply port becomes long correspondingly. As the ink supply port is simply elongated as a through hole formed through a device substrate, rigidity of the device substrate is lowered considerably. As the rigidity of the device substrate lowers, there is a risk of breaking the substrate during manufacture of an ink jet recording head and influencing a manufacture yield. In order to raise the rigidity of a device substrate, the size of the device substrate may be increased. However, a large substrate size reduces the number of heads to be manufactured from one wafer, resulting in a cost increase.

Japanese Patent Application Laid-open No. 2003-039692 discloses the structure that an ink supply port is divided into a plurality of ports by using beams. FIG. 8A is a partially transmissive plan view showing an example of an ink jet recording head with a plurality of divided ink supply ports, FIG. 8B is a cross sectional view taken along line 8B-8B of FIG. 8A, FIG. 8C is a cross sectional view taken along line 8C-8C of FIG. 8A, and FIG. 8D is a cross sectional view taken along line 8D-8D of FIG. 8A. An ink jet recording head 300 shown in FIGS. 8A, 8B, 8C and 8D has the structure that a plurality of beam portions 311*a* are formed in a single, long ink supply port 311 formed in a substrate 301, and this structure is very effective for retaining the rigidity of the substrate 301. However, as the ink supply port 311 is divided by the beam portions 311*a*, a separate flow path 306 (communicating with a common flow path 308 and corresponding to each discharge pressure generating element 305) positioned between ink supply ports 311, i.e., near at the beam portion 311*a* has an insufficient ink supply, so that ink refill is delayed more than other separate flow paths 306 formed at positions remote from the beam portion 311*a*.

Japanese Patent Application Laid-open No. H06-115075 proposes that a bottom region of a common flow path on the surface of a substrate is etched widely to form a groove and a supply port communicating with the groove is formed. With this groove, it is expected that the supply port can be shortened and the supply port can be broadened correspondingly to improve ink refill for all separate flow paths and that a difference between ink refill due to a different relative position to the supply port can be relaxed. With this method, it is necessary to form a deeper groove in order to sufficiently relax the ink refill difference. However, as the groove is formed deeper in a wide region, the strength and rigidity of the substrate are lowered. The lowered strength of the substrate may cause breakage of the head during manufacture processes, resulting in a degraded yield. As the substrate rigidity is lowered, deformation of the substrate becomes large during manufacture processes or in use, so that ink discharge directions vary among orifices and the image quality is degraded.

In order to form a supply port at a good precision, the supply port is formed in some cases by dry etching such as reactive ion etching (RIE). Generally, although dry etching provides a high precision, it has disadvantage in terms of tact as compared to other etching processes because of single wafer processing and a low etching rate. In order to overcome the disadvantages, a substrate as thin as possible, to the extent that the strength and rigidity of the substrate are ensured, is prepared, or a substrate is thinned by grinding, wet etching or the like having a high processing performance. Thereafter, the supply port is formed by dry etching. In this case, if a groove is formed in a wide range on the bottom of the common flow path, the groove cannot be sufficiently deep in order to maintain the strength and rigidity of the substrate, so that the advantages of the groove cannot be obtained.

This method is associated with some issue of manufacture processes. For example, a method has been proposed to set a distance between the discharge pressure generating element and an orifice at a high precision and with good reproductivity by forming a flow path mold, a flow path wall and an orifice plate by solvent coating. However, if solvent coating is performed after the groove is formed deeply in a wide range of the substrate, the flow path mold and orifice plate have a saucer shape tracing the groove shape. Even if the groove is formed on the substrate, the orifice plate as the ceiling of the flow path has the saucer shape in conformity with the groove, so that the expected advantages cannot be obtained.

SUMMARY OF THE INVENTION

The present invention can provide an ink jet recording head and its manufacture method in which refill is sufficient and uniform for all orifices and separate flow paths and the substrate has a high rigidity by dividing the supply port into a plurality of ports.

In order to achieve this object, an ink jet recording head of the present invention comprises:

an orifice plate having orifices for discharging ink;

a substrate having a plurality of discharge pressure generating elements for discharging ink from the orifices and an ink supply port for supplying ink to the discharge pressure generating elements;

a plurality of separate flow paths corresponding to the discharge pressure generating elements; and a common flow path communicating with the separate flow paths and the ink supply port, wherein:

the substrate includes a plurality of beam portions formed to divide the ink supply port; and a recess is formed in a region corresponding to the common flow path of the substrate, the recess extending to the separate flow paths formed nearest to the beam portion.

According to the ink jet recording head of the present invention, it is possible to retain a sufficient rigidity of the substrate and provide sufficient and uniform refill of each separate flow path.

DESCRIPTION OF THE EMBODIMENTS

The present invention will be described in detail with reference to the accompanying drawings.

First Embodiment

Figure 1:
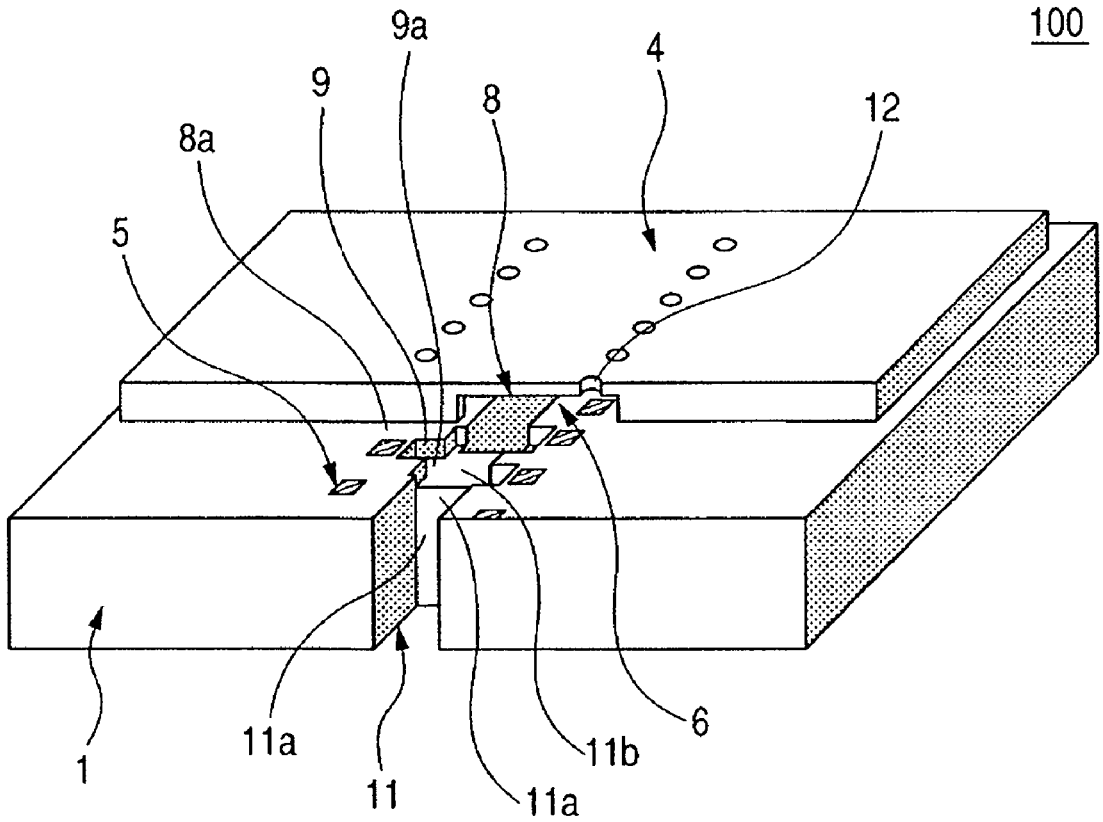
FIG. 1 is a partially broken perspective view of an ink jet recording head according to a first embodiment of the present invention.
Figure 2A:
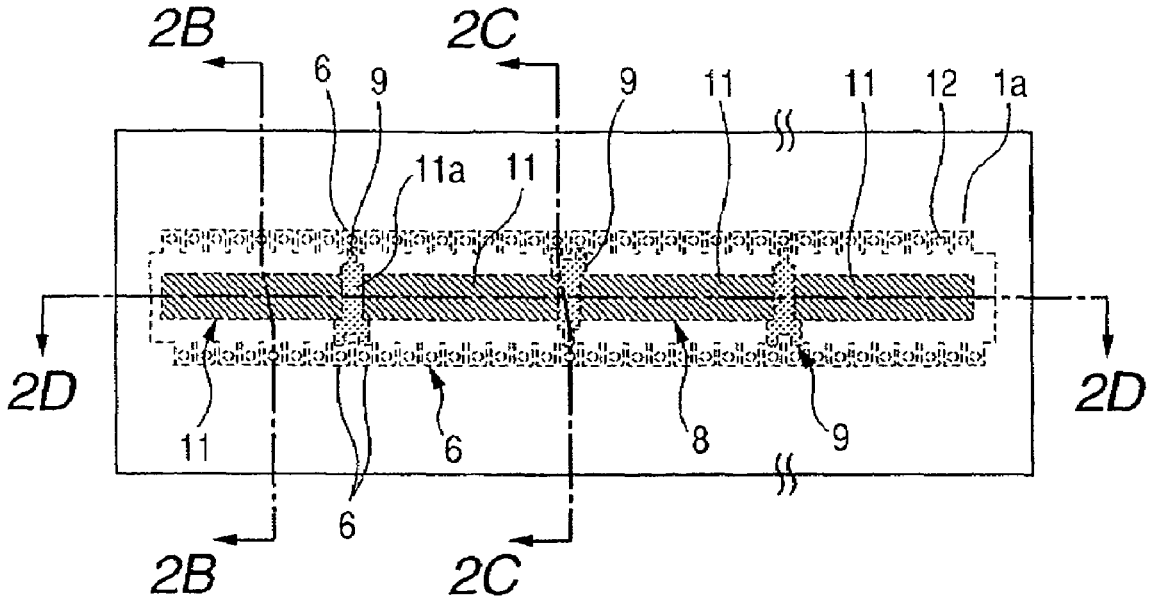
FIGS. 2A, 2B, 2C and 2D are a partially transmissive plan view and cross sectional views of the ink jet recording head according to the first embodiment of the present invention.
Figure 2B:
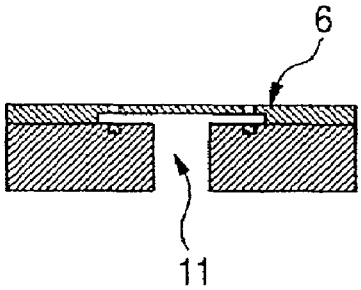
Figure 2C:
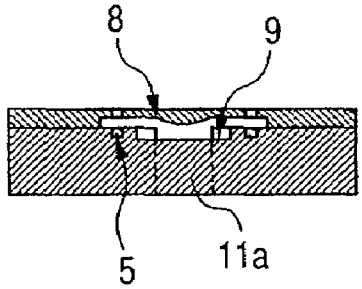
Figure 2D:
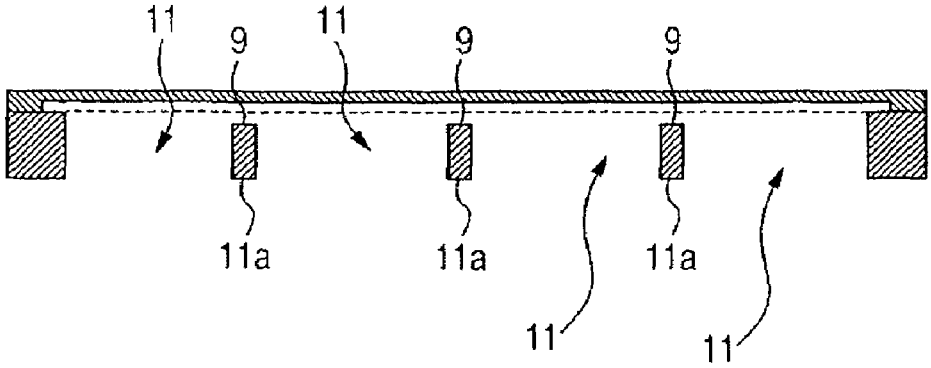

FIG. 1 is a partially broken perspective view of an ink jet recording head of the first embodiment. FIG. 2A is a partially transmissive plan view of the ink jet recording head of the first embodiment, FIG. 2B is a cross sectional view taken along line 2B-2B of FIG. 2A, FIG. 2C is a cross sectional view taken along line 2C-2C of FIG. 2A, and FIG. 2D is a cross sectional view taken along line 2D-2D of FIG. 2A.

As shown in FIG. 1, an ink jet recording head 100 of the embodiment is constituted of a substrate 1 having a plurality of discharge pressure generating elements 5 and an orifice plate 4 having orifices 12 corresponding to the discharge pressure generating elements 5. The discharge pressure generating elements 5 and Al wirings (not shown) for supplying an electric signal to the discharge pressure generating elements 5 are formed on the substrate 1 by film forming techniques.

Formed in the substrate 1 are a plurality of separate flow paths 6 corresponding to the discharge pressure generating elements 5, a common flow path 8 communicating with each separate flow path 6, and ink supply ports 11 supplying ink from an external to the common flow path 8 and divided by beam portions 11*a*. A recess 9 is formed in a region toward the separate flow path 6 formed nearest to each beam portion 11*a* dividing the ink supply ports 11, by etching the substrate 1 deeper than a common flow path bottom 8*a* of the common flow path 8. For the purposes of simplicity, in FIGS. 2A and 2D, the ink supply port 11 is divided into four ink supply ports 11 by three beam portions 11*a*. Namely, a recess bottom 9*a* of the recess 9 is made flush with a beam portion upper surface 11*b* of the beam portion 11*a*.

If the ink supply port 11 is made long, the opening becomes long so that the rigidity of the substrate 1 is lowered considerably. In order to retain the rigidity of the substrate 1, a plurality of beam portions 11*a* are provided, If the beam portion upper surface 11*b* of the beam portion 11*a* is set to the same height as that of the common flow path 8, a flow of ink from the ink supply port 11 to each separate flow path 6 near the beam portion 11*a* is influenced considerably by the beam portion 11*a*. In order to mitigate the influence of the beam portion 11*a* upon the ink flow, the recess 9 is formed for the separate flow path 6, and the beam upper surface 11*b* of the beam portion 11*a* is set to the same height as that of the recess bottom 9*a* of the recess 9, as described above. The recess 9 is formed only for the separate flow path 6 of the beam portion 11*a* so that reduction in the rigidity to be caused by the recess 9 is suppressed as much as possible.

The discharge pressure generating element 5 is an energy generating element for generating a discharge energy to be applied to ink. As the discharge pressure generating element 5 is driven to generate heat, ink on the discharge pressure generating element 5 is heated suddenly and voids are generated in the separate flow path 6 because of film boiling. A pressure generated by growth of the voids discharges ink from the orifice 12.

Next, with reference to FIGS. 3A, 3B, 3C, 3D, 3E, 3F, 3G and 3H, description will be made on a manufacture method for the ink jet recording head 100 of the embodiment.

Figure 3A:
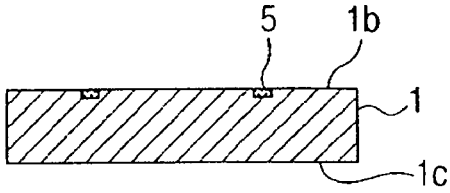
FIGS. 3A, 3B, 3C, 3D, 3E, 3F, 3G and 3H are diagrams illustrating manufacture processes for the ink jet recording head according to the first embodiment of the present invention.

A heat generating resistor member as the discharge pressure generating element 5 and its drive circuit are formed on a silicon substrate 1 by general semiconductor device manufacture processes (FIG. 3A). The surface of the substrate 1 on the side of the heat generating resistor member is called a top surface 1*b* and the surface opposite to the top surface 1*b* is called a bottom surface 1*c*.

Next, resist is coated on the top surface 1*b* of the substrate 1. By using photolithography techniques, the resist is exposed, developed and removed in an area from the position where the ink supply port 11 is formed to a position in front of the position where the separate flow path 6 is formed, near the region between the ink supply ports 11, i.e., near the beam portion 11*a*. This removed region may not be terminated at the position in front of the position where the separate flow path 6 is formed, but may be extended to the inside of the separate flow path 6.

Figure 3B:
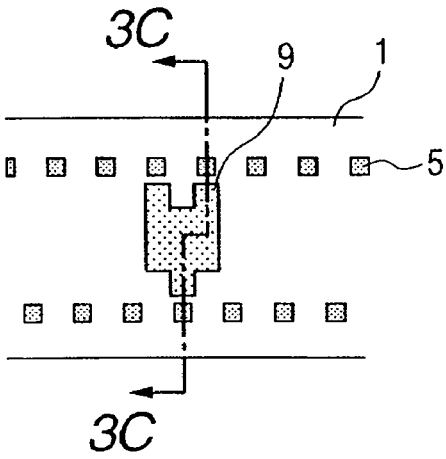
Figure 3C:
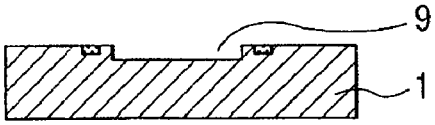

Next, as shown in FIG. 3B, the region where the resist was removed is etched to form a recess 9. The recess 9 may be formed by dry etching, wet etching or physical processing such as laser processing and ion milling. For etching, an inductively coupled plasma (ICP)—reactive ion etching (RIE) etcher may be used and SF6 and C2F8 gases may be used. FIG. 3C is a cross sectional view taken along line 3C-3C of FIG. 3B.

A silicon oxide film is formed by plasma CVD, the silicon oxide film being used as an etching stopper layer.

Figure 3D:
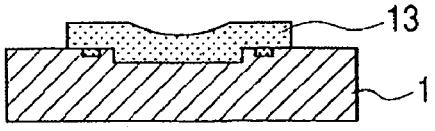

Next, polymethylisopropenylketone is solvent-coated, the polymethylisopropenylketone being UV resist capable of being melted at a later process. This resist is exposed to UV light and developed to form a flow path mold 13 (FIG. 3D).

Figure 3E:
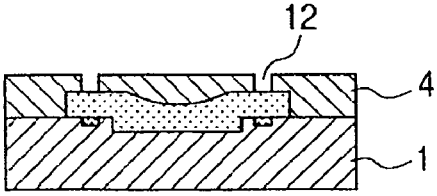

Cation polymer type epoxy resin as negative resist is coated to form a ceiling of an ink flow path and a flow path wall partitioning each flow path. This negative resist is exposed and developed by using a photomask having a predetermined pattern to remove the negative resist in an orifice 12 and an electrode pad to form an orifice plate 4 (FIG. 3E).

Figure 3F:
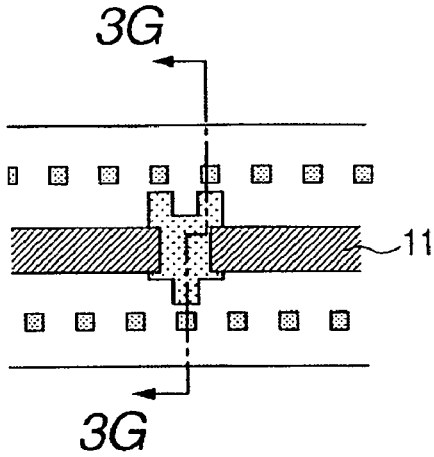
Figure 3G:
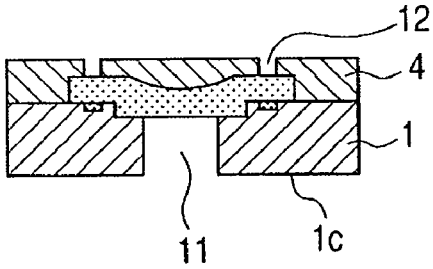

Resist is coated on both the surfaces 1*b* and 1*c* of the substrate 1. The resist on the bottom surface 1*c* is patterned by photolithography techniques, having a predetermined pattern with an opening at the position where the ink supply port 11 is formed. By using this resist as a mask, the ink supply port 11 is formed through the substrate 1 by dry etching (FIG. 3F). The ink supply port 11 may be formed by dry etching, wet etching, mechanical processing such as drill and sand blast, or physical processing such as laser processing and ion milling. Similar to the process of forming the recess 9, dry etching may use an ICP-RIE etcher. FIG. 3G is a cross sectional view taken along line 3G-3G of FIG. 3F.

Figure 3H:
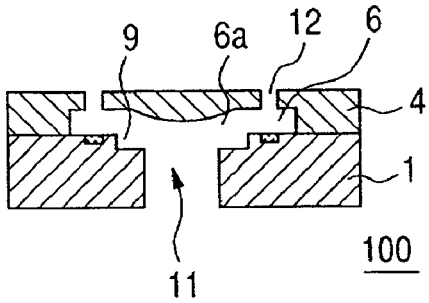

The resist on both the surfaces 1*b* and 1*c* of the substrate is removed with remover liquid. The flow path mold 13 is exposed via the orifice plate and immersed in methyl lactate to remove the flow path mold 13 and form the common flow path 8 and separate flow paths 6 corresponding to the discharge pressure generating elements 5. In this case, ultrasonic waves may be applied (FIG. 3H).

Lastly, the ink jet recording head 100 of the embodiment is obtained by dicing the substrate.

The ink jet recording head 100 of the embodiment has a plurality of beam portions 11*a* in the ink supply port 11 so that the rigidity of the substrate 1 can be retained. Further, the ink jet recording head 100 of the embodiment has the recess 9 etched deeper than the common flow path bottom 8*a* of the common flow path 8, the recess being formed only on the separate flow paths 6 nearest to the beam portion 11*a* corresponding to the discharge pressure generating elements 5 nearest to the beam portion 11*a*. It is therefore possible to suppress reduction in the rigidity of the substrate 1. Furthermore, in the ink jet recording head 100 of the embodiment, the recess bottom 9*a* of the recess 9 is made flush with the beam portion upper surface 11*b* of the beam portion 11*a*. Namely, the beam portion 11*a* mitigates the influence upon an ink flow from the ink supply port 11 to each separate flow path 6.

As described above, the ink jet recording head 100 of the embodiment has the structure that the recess 9 is formed only on the separate flow paths 6 formed nearest to the beam portion 11*a*. It is therefore possible to satisfy both suppression of reduction in the rigidity of the substrate 1 and sufficient and uniform ink refill of each separate flow path 6.

Second Embodiment

Figure 4A:
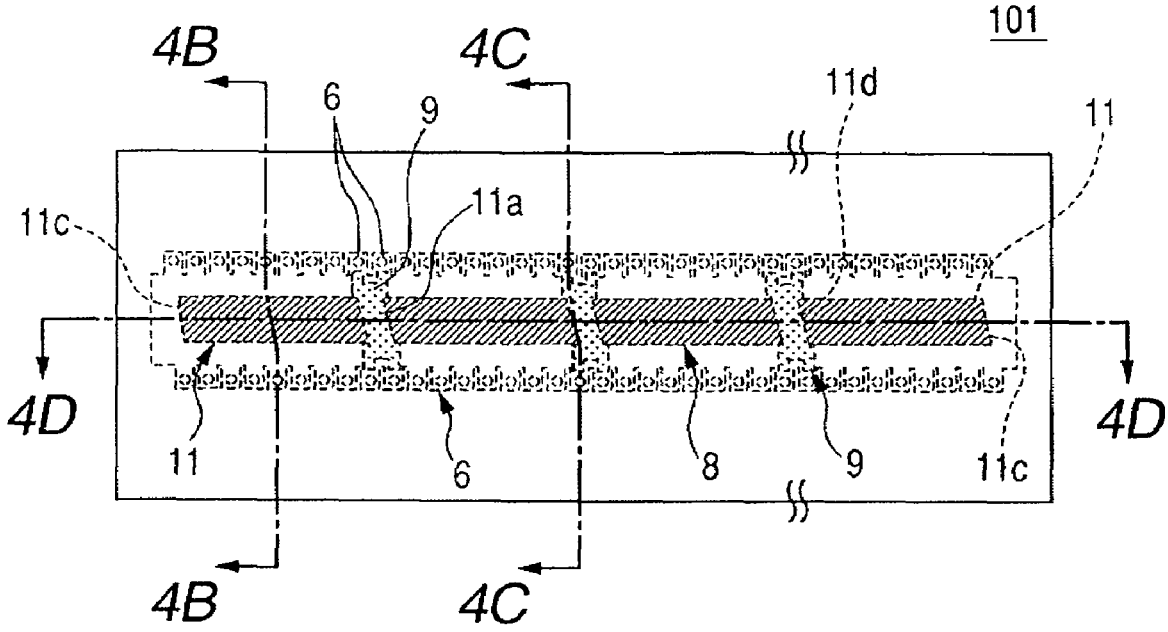
FIGS. 4A, 4B, 4C and 4D are a partially transmissive plan view and cross sectional views of an ink jet recording head according to a second embodiment of the present invention.
Figure 4B:
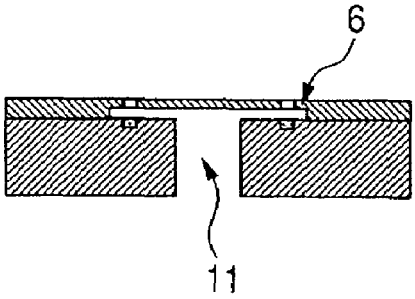
Figure 4C:
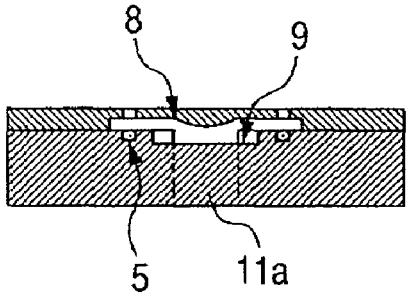
Figure 4D:
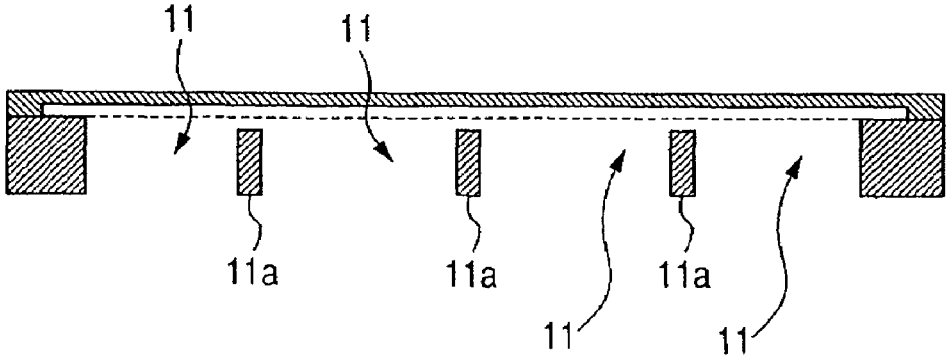

FIG. 4A is a partially transmissive plan view of an ink jet recording head of the second embodiment, and FIGS. 4B, 4C and 4D are cross sectional views thereof. FIG. 4B is a cross sectional view taken along line 4B-4B of FIG. 4A, FIG. 4C is a cross sectional view taken along line 4C-4C of FIG. 4A, and FIG. 4D is a cross sectional view taken along line 4D-4D of FIG. 4A.

In the ink jet recording head 101 of the embodiment, the opening cross sectional shape of the ink supply port 11 is a parallelogram, and the beam portion 11*a* is also a parallelogram as shown in FIG. 4A. Namely, the opening cross sectional shape of the ink supply port 11 is a parallelogram, and the side 11*d* of the beam portion 11*a* is parallel to the short side 11*c* of the ink supply port 11*a*. The other structures are fundamentally similar to those of the ink jet recording head 100 of the first embodiment, and the detailed description is omitted and similar reference symbols are used. In the second embodiment, although the opposite recesses 9 of the beam portion 11*a* communicate with two separate flow paths 6, one may communicate with one separate flow path 6 and the other may communicate with two separate flow paths 6 as shown in the first embodiment.

The shape of the ink supply port 11 of the ink jet recording head 101 of the second embodiment is a parallelogram, because the layout of separate flow paths displaces by a half pitch on opposite sides of the ink supply port 11. With the parallelogram arrangement, the relative positions of the discharge pressure generating element 5 and recess 9 as measured from opposite ends of the ink supply port 11 become the same on both sides of the ink supply port 11. It is therefore possible to maintain generally the same ink flow change characteristics even if ink is discharged randomly.

Third Embodiment

Figure 5A:
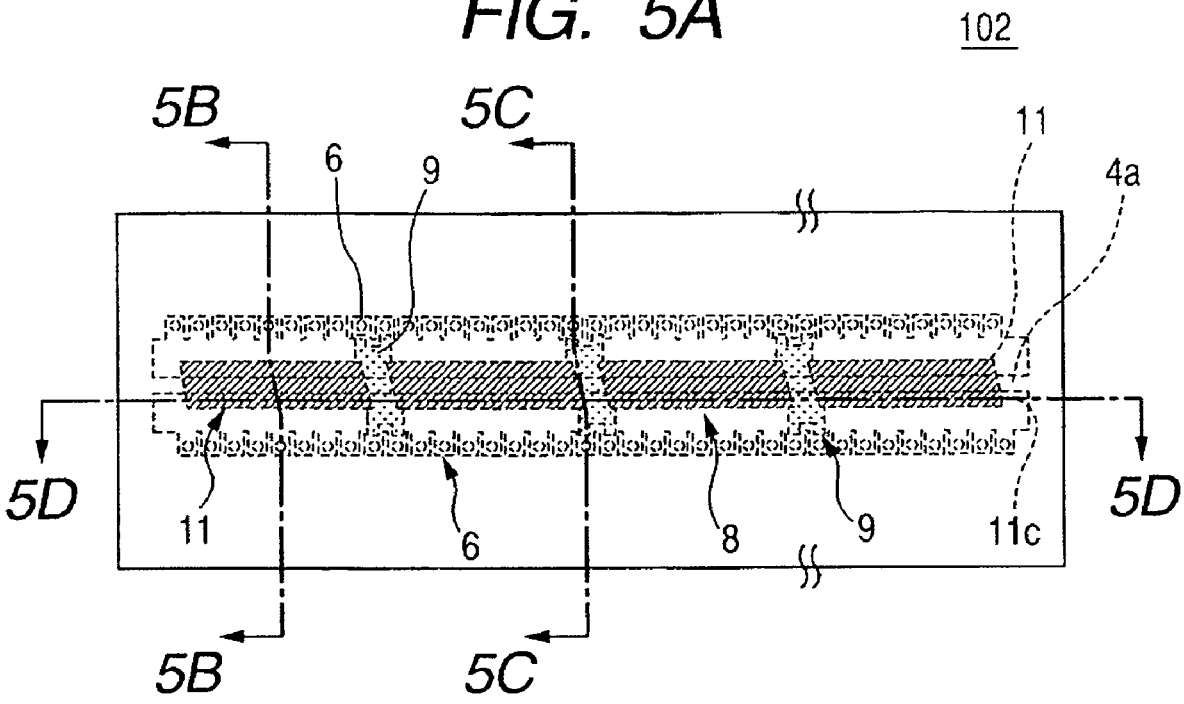
FIGS. 5A, 5B, 5C and 5D are a partially transmissive plan view and cross sectional views of an ink jet recording head according to a third embodiment of the present invention.
Figure 5B:
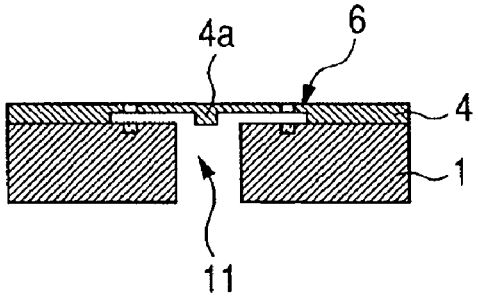
Figure 5C:
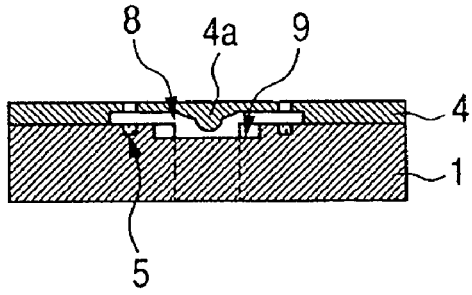
Figure 5D:
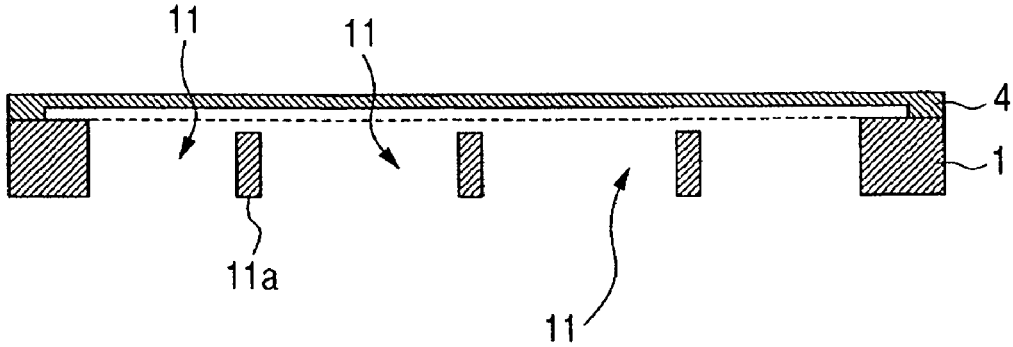

FIG. 5A is a partially transmissive plan view of an ink jet recording head of the third embodiment, FIG. 5B is a cross sectional view taken along line 5B-5B of FIG. 5A, FIG. 5C is a cross sectional view taken along line 5C-5C of FIG. 5A, and FIG. 5D is a cross sectional view taken along line 5D-5D of FIG. 5A.

The ink jet recording head 102 of the embodiment has an orifice side beam 4*a* at the position corresponding to the ink supply port 11 along a longitudinal direction of the ink supply port 11. The other structures are fundamentally similar to those of the ink jet recording head 101 of the second embodiment, and the detailed description is omitted and similar reference symbols are used.

Generally, the orifice plate 4 of a side shooter type ink jet recording head floats over the ink supply port 11 in a wide range and the strength and rigidity of the substrate structure are weakened. In this embodiment, in order to prevent the orifice plate in the region corresponding to the ink supply port 11 from being floated and to retain the strength and rigidity of the ink jet recording head, the orifice side beam 4*a* is formed on the orifice plate. The cross sectional shape of the orifice side beam 4*a* may be any shape so long as it retains the rigidity of the orifice plate 4. In this embodiment, as shown in FIG. 5B, the cross sectional shape of the orifice side beam 4*a* in the region not corresponding to the recess 9 is rectangular in order to increase the cross sectional area as much as possible. On the other hand, as shown in FIG. 5C, the cross sectional shape of the orifice side beam in the region corresponding to the recess 9 is a smooth curved shape not hindering an ink flow in order to have a sufficient and uniform ink refill of the separate flow path 6. The orifice side beam 4*a* may gradually increase a side thickness. The orifice side beam 4*a* may be formed not on the side facing the substrate, but on the opposite side.

The orifice side beam 4*a* can be formed by exposing, developing and removing the region where the orifice side beam 4*a* is formed above the ink supply port 11, when the flow path mold 13 is patterned in the manufacture process for the ink jet recording head described with the first embodiment.

Fourth Embodiment

Figure 6A:
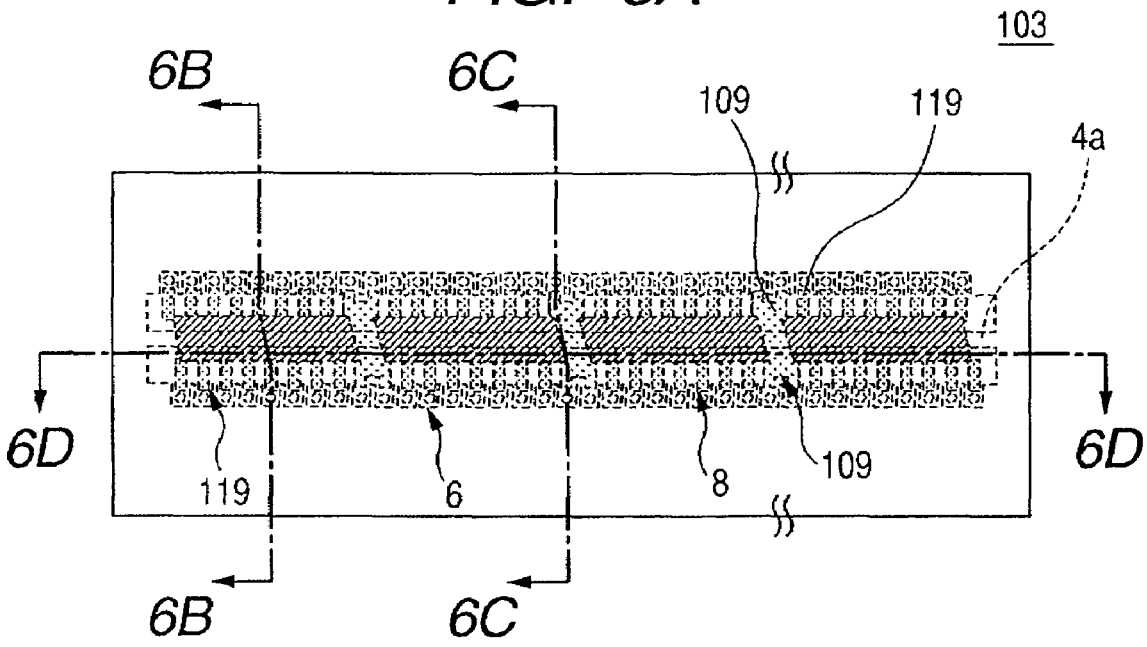
FIGS. 6A, 6B, 6C and 6D are a partially transmissive plan view and cross sectional views of an ink jet recording head according to a fourth embodiment of the present invention.
Figure 6B:
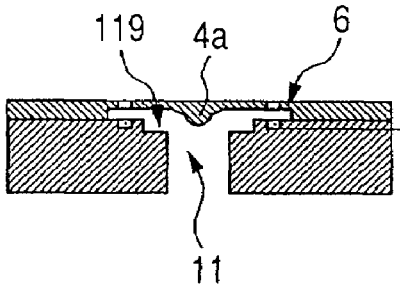
Figure 6C:
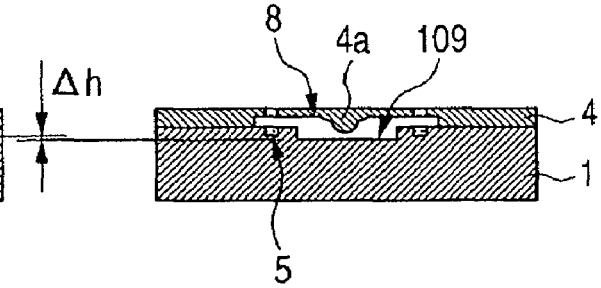
Figure 6D:
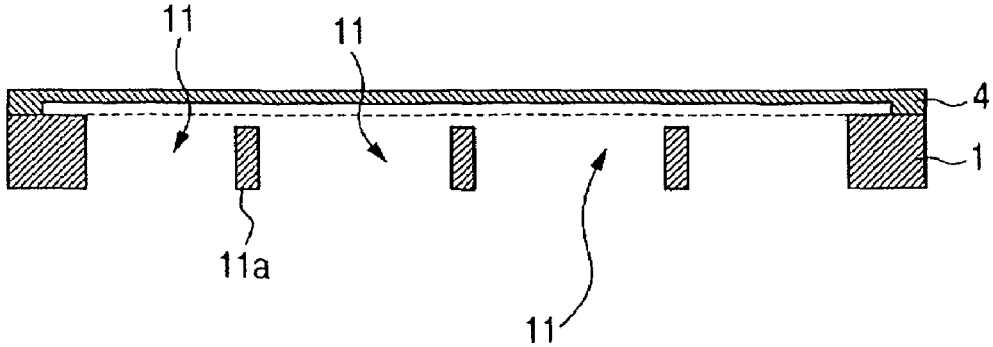

FIG. 6A is a partially transmissive plan view of an ink jet recording head of the third embodiment, FIG. 6B is a cross sectional view taken along line 6B-6B of FIG. 6A, FIG. 6C is a cross sectional view taken along line 6C-6C of FIG. 6A, and FIG. 6D is a cross sectional view taken along line 6D-6D of FIG. 6A.

The ink jet recording head 103 of the embodiment has a deep recess 109 having the same depth as that of the recess 9 of the above-described embodiments and having no step relative to the beam portion 11*a* and a shallow recess 119 shallower by Δh than the deep recess 109. The other structures are fundamentally similar to those of the ink jet recording head 102 of the third embodiment, and the detailed description is omitted and similar reference symbols are used.

Similar to each of the above-described embodiments, the deep recess 109 is formed extending to the separate flow paths 6 nearest to the beam portion 11*a*. The shallow recess 119 is formed corresponding to the remaining separate flow paths 6 relatively remote from the beam portion 11*a*. Namely, the shallow recess is formed extending to the separate flow paths 6 other than the separate flow paths 6 nearest to the beam portion 11*a*. In the ink jet recording head 103 of the embodiment, the recess is formed for all separate flow paths 6, extending to a position in front of, or inside the ink supply port 11. Accordingly, not only a refill speed for all separate flow paths is improved but also a difference between ink refill characteristics of the separate flow paths 6 can be reduced and the uniform refill characteristics can be retained.

The deep recess 109 and shallow recess 119 having different depths can be formed by repeating resist patterning and etching a plurality of times to form recesses having desired depths. Alternatively, a so-called dual mask method may be used to conduct etching to a desired depth by using each mask.

Fifth Embodiment

Figure 7A:
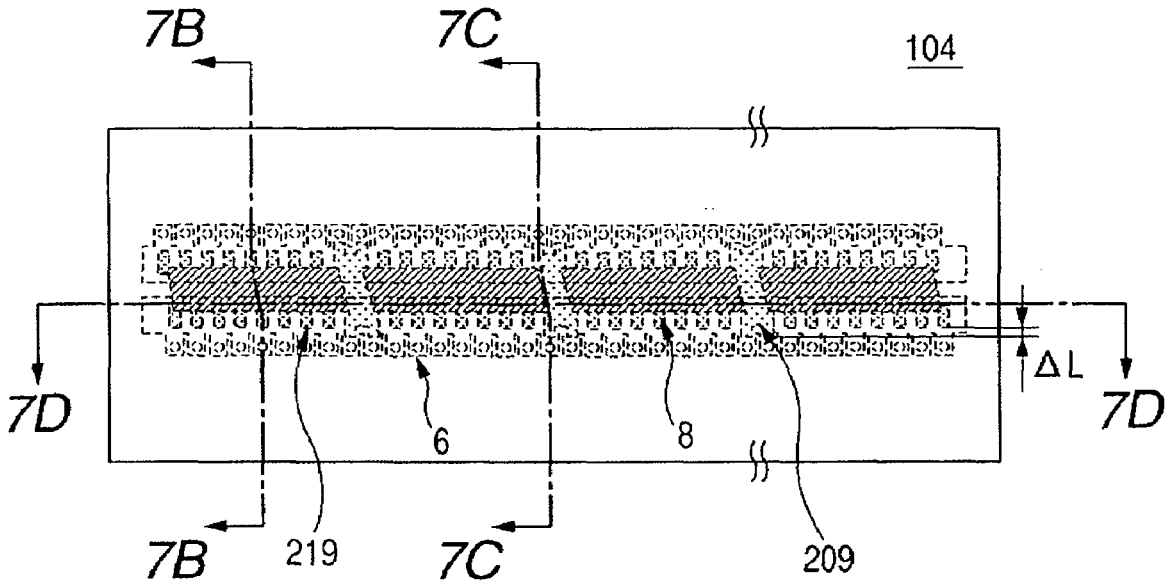
FIGS. 7A, 7B, 7C and 7D are a partially transmissive plan view and cross sectional views of an ink jet recording head according to a fifth embodiment of the present invention.
Figure 7B:
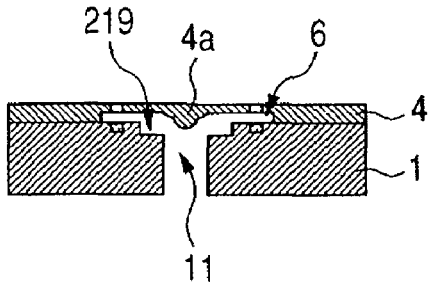
Figure 7C:
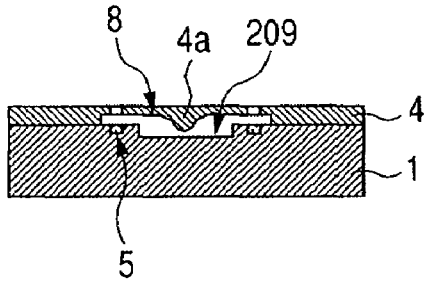
Figure 7D:
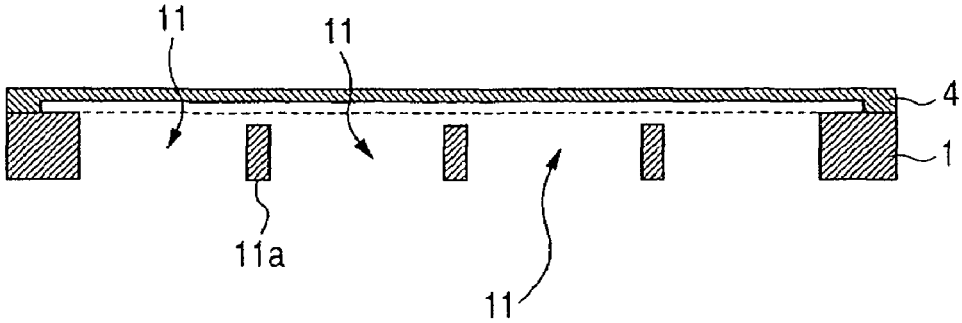
Figure 8A:
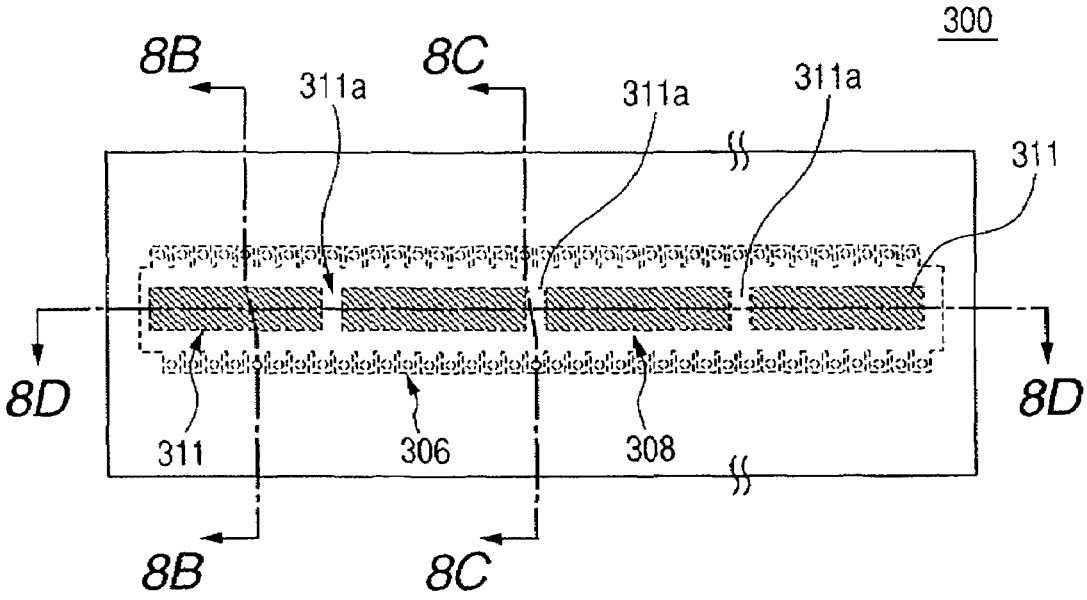
FIGS. 8A, 8B, 8C and 8D are a partially transmissive plan view and cross sectional views of a conventional ink jet recording head.
Figure 8B:
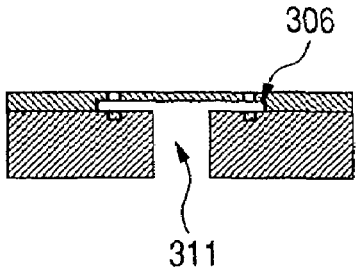
Figure 8C:
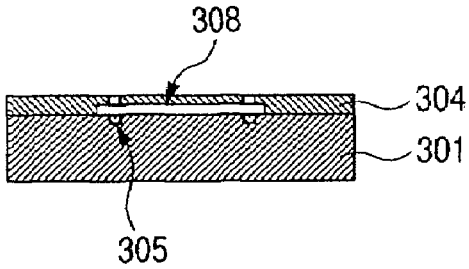
Figure 8D:
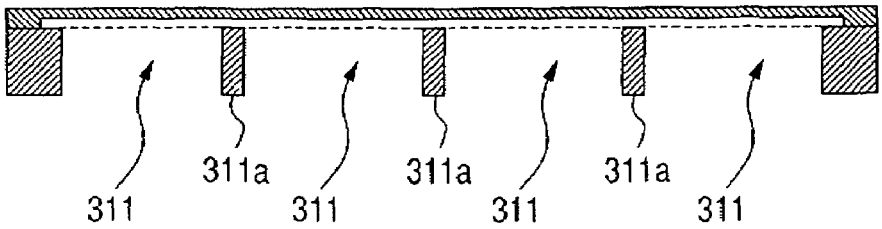

FIG. 7A is a partially transmissive plan view of an ink jet recording head of the third embodiment, FIG. 7B is a cross sectional view taken along line 7B-7B of FIG. 7A, FIG. 7C is a cross sectional view taken along line 7C-7C of FIG. 7A, and FIG. 7D is a cross sectional view taken along line 7D-7D of FIG. 7A.

The ink jet recording head 104 of the embodiment has a long recess 209 having the same length as that of the recess 9 of the above-described embodiments and having no step relative to the beam portion 11*a* and a short recess 219 shorter by ΔL than the long recess 209. Namely, the short recess 219 is formed in the substrate 1 of the embodiment between the ink supply port 11 and separate flow paths 6 other than the separate flow paths 6 nearest to the beam portion. The short recess 219 is shorter by ΔL in full length than that of the long recess 209. The other structures are fundamentally similar to those of the ink jet recording head 102 of the third embodiment, and the detailed description is omitted and similar reference symbols are used.

Similar to each of the above-described embodiments, the long recess 209 is formed extending to the separate flow paths 6 nearest to the beam portion 11*a*. The short recess 219 is formed corresponding to the remaining separate flow paths 6 relatively remote from the beam portion 11*a*. In the ink jet recording head 104 of the embodiment, the recess is formed for all separate flow paths 6, extending to a position in front of, or inside the ink supply port 11. Accordingly, not only a refill speed for all separate flow paths is improved but also a difference between ink refill characteristics of the separate flow paths 6 can be reduced and the uniform refill characteristics can be retained. Since the short recess 219 is shortened by ΔL than the long recess 209, the thickness of the substrate is left unetched by ΔL so that the rigidity of the substrate 1 can be improved by an amount corresponding to the left thickness.

This application claims priority from Japanese Patent Application No. 2005-083556 filed Mar. 23, 2005, which is hereby incorporated by reference herein.

What is claimed is:

1. An ink jet recording head comprising:

an orifice plate having orifices for discharging ink;

a substrate having a plurality of discharge pressure generating elements for discharging ink from said orifices and an ink supply port for supplying ink to said discharge pressure generating elements;

a plurality of separate flow paths corresponding to said discharge pressure generating elements; and a common flow path communicating with said separate flow paths and said ink supply port, wherein said substrate includes a plurality of beam portions formed to divide said ink supply port, a recess is formed in a region corresponding to said common flow path of said substrate, said recess extending to said separate flow paths formed nearest to said beam portions, and a shallow recess is formed in a region extending to said separate flow paths other than said separate flow paths formed nearest to said beam portion, and said shallow recess has a shallower depth than a depth from a bottom of said common flow path to a bottom of said recess.

2. An ink jet recording head comprising:

an orifice plate having orifices for discharging ink;

a substrate having a plurality of discharge pressure generating elements for discharging ink from said orifices and an ink supply port for supplying ink to said discharge pressure generating elements;

a plurality of separate flow paths corresponding to said discharge pressure generating elements; and a common flow path communicating with said separate flow paths and said ink supply port, wherein said substrate includes a plurality of beam portions formed to divide said ink supply port, a recess is formed in a region corresponding to said common flow path of said substrate, said recess extending to said separate flow paths formed nearest to said beam portions, and a short recess is formed in a region between said separate flow paths other than said separate flow paths formed nearest to said beam portions and said ink supply port, and said short recess has a full length shorter than a full length of said recess from said ink supply port to said separate flow paths.

3. An ink jet recording head comprising:

an orifice plate having orifices for discharging ink;

a substrate having a plurality of discharge pressure generating elements for discharging ink from said orifices and an ink supply port for supplying ink to said discharge pressure generating elements;

a plurality of separate flow paths corresponding to said discharge pressure generating elements; and a common flow path communicating with said separate flow paths and said ink supply port, wherein said substrate includes a plurality of beam portions formed to divide said ink supply port, a recess is formed in a region corresponding to said common flow path of said substrate, said recess extending to said separate flow paths formed nearest to said beam portions, and an opening cross-sectional shape of said ink supply port is a parallelogram and a side of said beam portions is formed parallel to a short side of said ink supply port.

* * * * *